US006033319A

United States Patent [19]

Farrar

[11] Patent Number: 6,033,319

[45] Date of Patent: Mar. 7, 2000

[54] GOLF CLUB

[76] Inventor: Craig H. Farrar, 7100 San Ramon Rd., #128, Dublin, Calif. 94568

[21] Appl. No.: 09/219,553

[22] Filed: Dec. 21, 1998

[51] Int. Cl.[7] ..... A63B 53/02

[52] U.S. Cl. ..... 473/313; 473/314; 473/345

[58] Field of Search ..... 473/313, 314, 473/329, 324, 340, 219, 332, 251, 345; D21/736, 740, 757

[56] References Cited

U.S. PATENT DOCUMENTS

| | | |
|---|---|---|
| D. 279,497 | 7/1985 | Brown . |
| D. 341,404 | 11/1993 | Kruh . |
| 1,250,296 | 12/1917 | Fitzjohn . |
| 3,675,923 | 7/1972 | Allen . |
| 3,841,640 | 10/1974 | Gaulocher . |
| 4,010,958 | 3/1977 | Long . |
| 4,077,633 | 3/1978 | Studen . |
| 4,815,739 | 3/1989 | Donica . |
| 5,160,141 | 11/1992 | Crews . |

OTHER PUBLICATIONS

Advertisement of a putter made available by DTM Golf Products of Cleveland, Ohio (no date).

*Primary Examiner*—Sebastiano Passaniti
*Attorney, Agent, or Firm*—Thomas R. Lampe

[57] ABSTRACT

A golf club includes a club head having a hollow interior. A reinforcement member including two diverging elongated elements is located within the hollow interior and the distal ends of the elongated elements are attached to spaced enlarged ends of the front portion of the club head.

15 Claims, 7 Drawing Sheets

GOLF CLUB

TECHNICAL FIELD

This invention relates to a golf club and has particular application to a putter.

BACKGROUND OF THE INVENTION

A very large number of golf club designs have been devised over the years. Putters especially come in a wide variety of constructions. A search of the patent art located the following United States patents which have some degree of pertinence to the invention disclosed and claimed herein: U.S. Pat. No. 4,077,633, issued Mar. 7, 1978, U.S. Pat. No. 5,160,141, issued Nov. 3, 1992, U.S. Design Patent No. 341,404, issued Nov. 16, 1993, and U.S. Design Patent No. 279,497, issued Jul. 2, 1985.

Also of interest is a putter made available by DTM Golf Products of Cleveland, Ohio which locates the hosel at the center of the putter head and employs heel and toe weights which allegedly provide better balance and control.

DISCLOSURE OF INVENTION

The present invention relates to a golf club of unique construction which incorporates a combination of structural elements in a unique manner to provide a number of advantages. The invention is particularly applicable to putters but the teachings of the invention are potentially applicable to other types of golf clubs as well.

The club construction transfers force to the club shaft in a novel manner and stabilizes the club head by resisting turning thereof at impact. Improved balance and control as compared to conventional putter heads is provided. The structural elements of the club cooperate to provide an enlarged "sweet spot" at the club head face.

The golf club of the present invention includes a club head defining a hollow interior and including a club back portion and a club front portion spaced from the said back portion having a golf ball striking face and spaced club first and second front portion ends. The club head also includes a club head top portion connected to the club head front portion and extending rearwardly therefrom over the hollow interior toward the club head back portion.

A reinforcement member is connected to the club head and disposed in the hollow interior. The reinforcement member includes an attachment element for connection to a club shaft and first and second elongated elements attached to the attachment element and projecting therefrom. The attachment element is located at the club head back portion and the first and second elongated elements diverge away from one another in the direction of the club head front portion. The first and second elongated elements have spaced distal ends. The distal end of the first elongated element is attached to the first front portion end and the distal end of the second elongated element is attached to the second club portion end. The reinforcement member and the club head front portion between the first and second front portion ends define a void therebetween.

Other features, advantages, and objects of the present invention will become apparent with reference to the following description and accompanying drawings.

MODES FOR CARRYING OUT THE INVENTION

Figure 1:
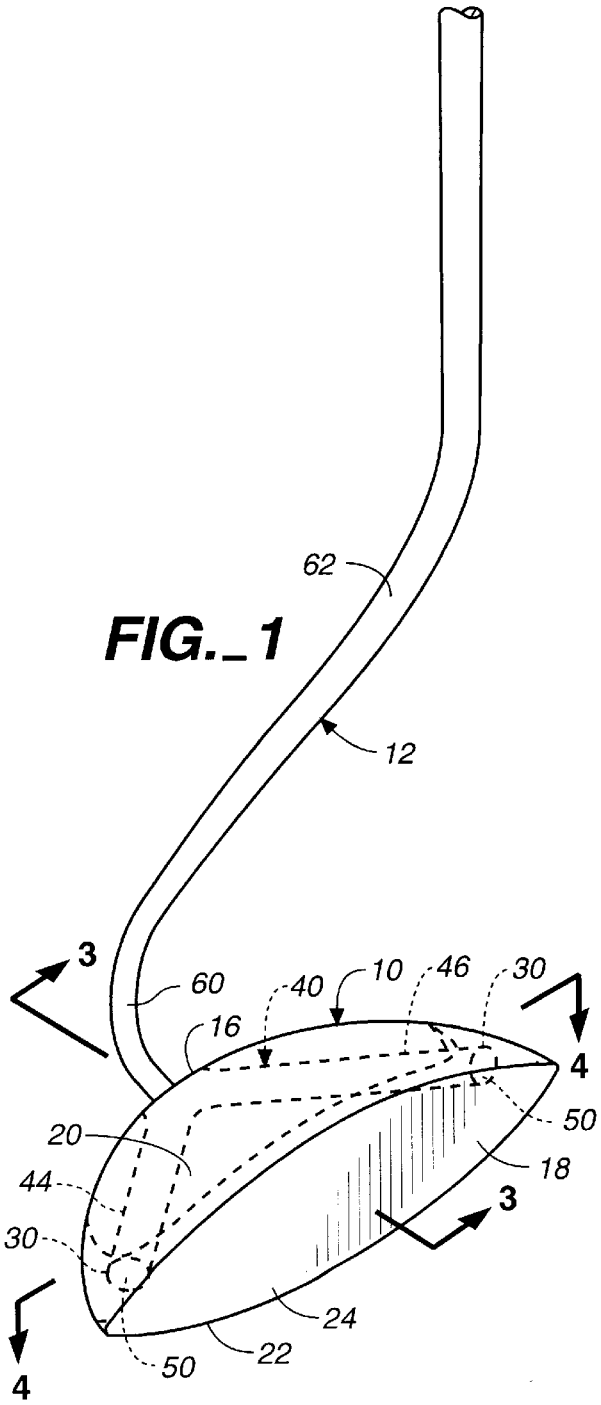
FIG. 1 illustrates a putter head and a portion of a club shaft attached thereto constructed in accordance with the teachings of the present invention, a reinforcement member located in the interior of the club head being shown in dash lines.
Figure 3:
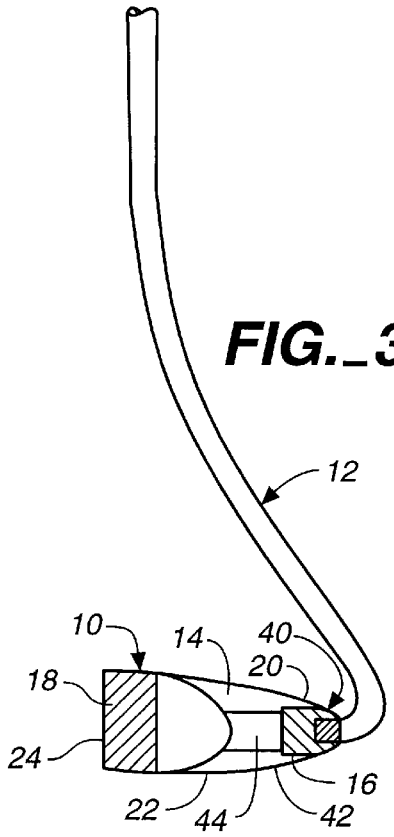
FIG. 3 is a cross-sectional view taken along the line 3—3 in FIG. 4.
Figure 4:
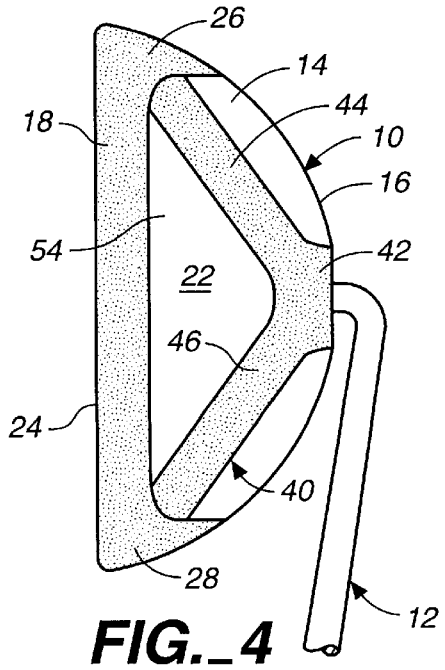
FIG. 4 is a view taken along line 4—4 of FIG. 1 and illustrating details of a reinforcement member employed in the construction and details of the club head front portion with which the reinforcement member cooperates.
Figure 2:
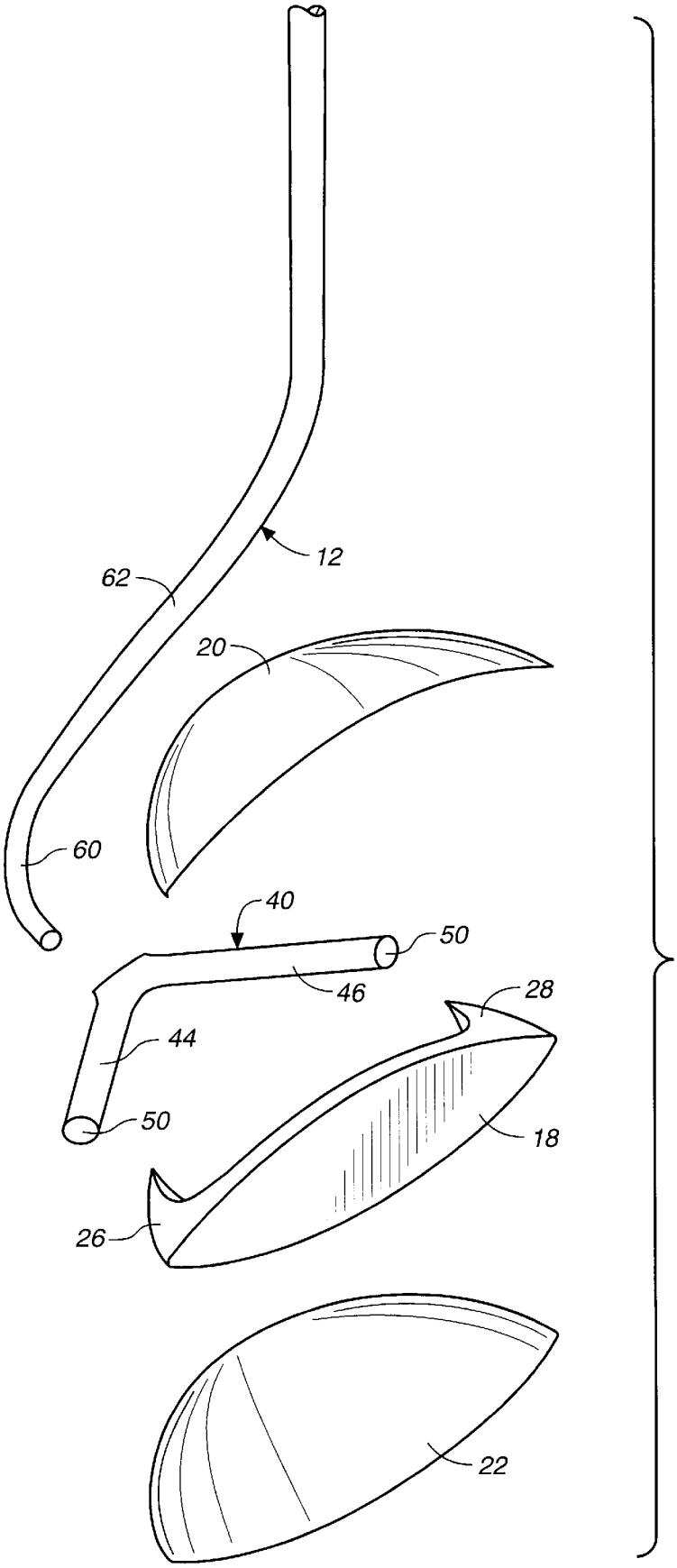
FIG. 2 is an exploded perspective view of the putter of FIG. 1.
Figure 5:
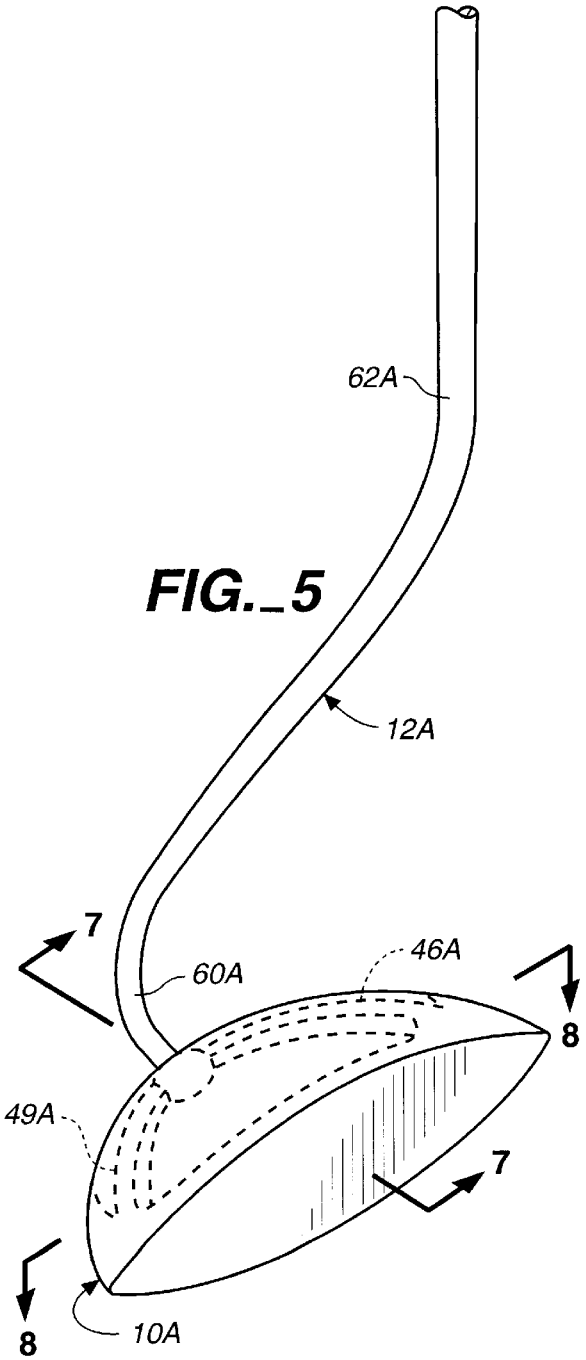
FIG. 5 is a view similar to FIG. 1 but illustrating an alternative embodiment of the invention.
Figure 7:
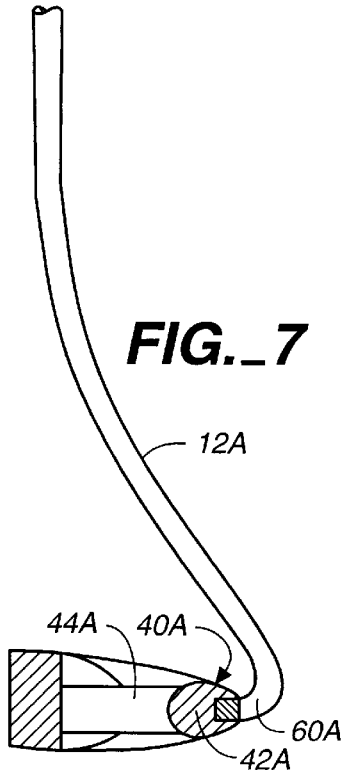
FIG. 7 is a cross-sectional view taken along the line 7—7 of FIG. 5.
Figure 8:
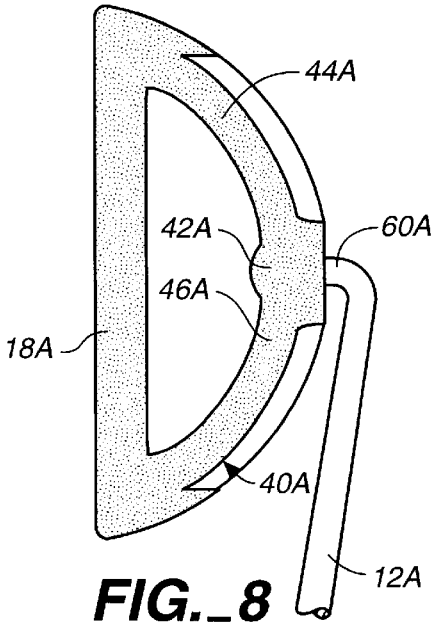
FIG. 8 is a view taken along the line 8—8 of FIG. 5, the view being similar to that of FIG. 4.
Figure 6:
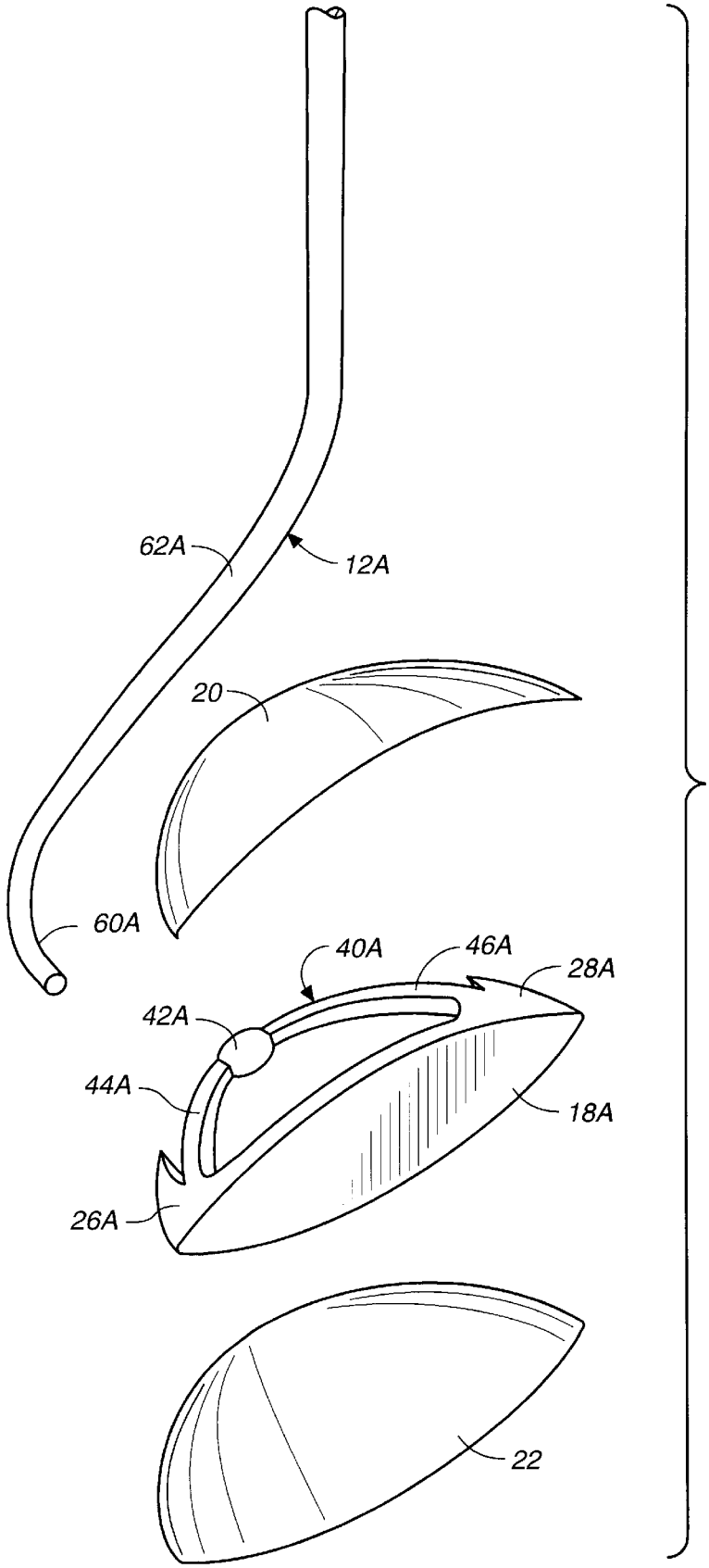
FIG. 6 is a view similar to FIG. 2 of the alternative embodiment.
Figure 9:
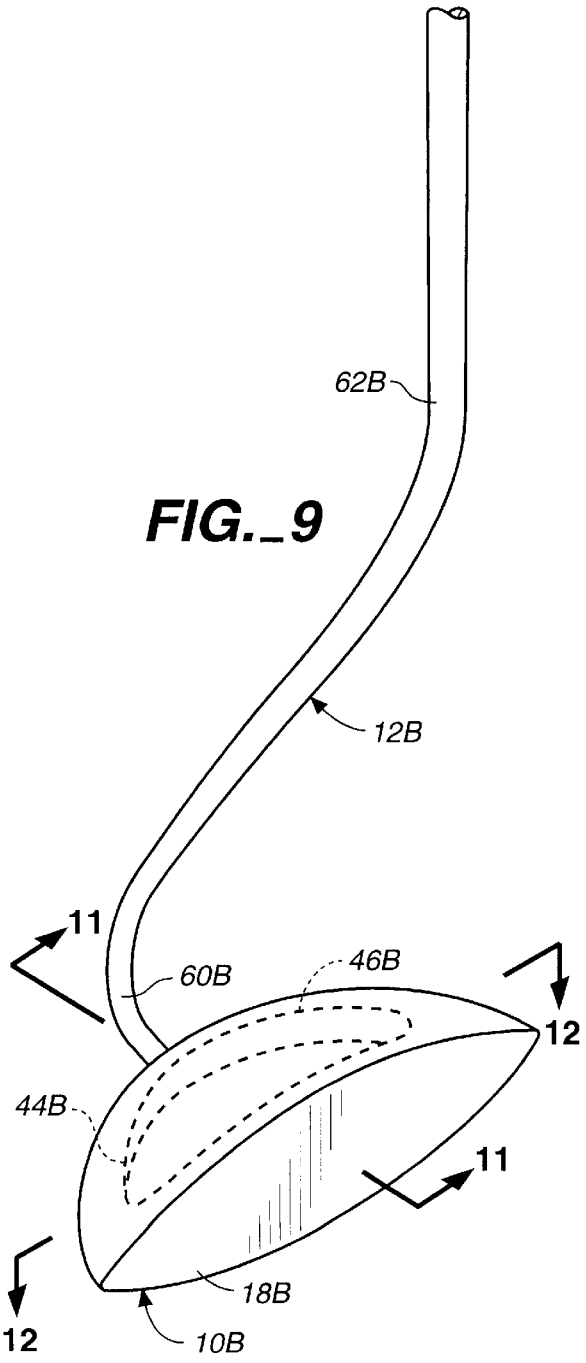
FIG. 9 is a view similar to FIG. 1 but illustrating a second alternative embodiment of the invention.
Figure 11:
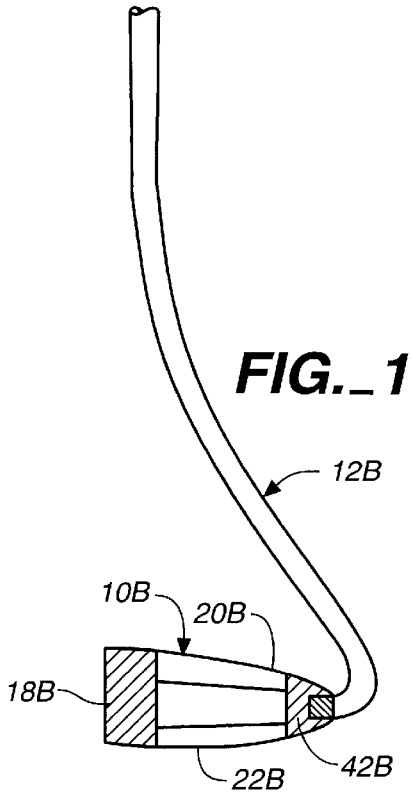
FIG. 11 is a cross-sectional view taken along the line 11—11 in FIG. 9 of the second alternative embodiment.
Figure 12:
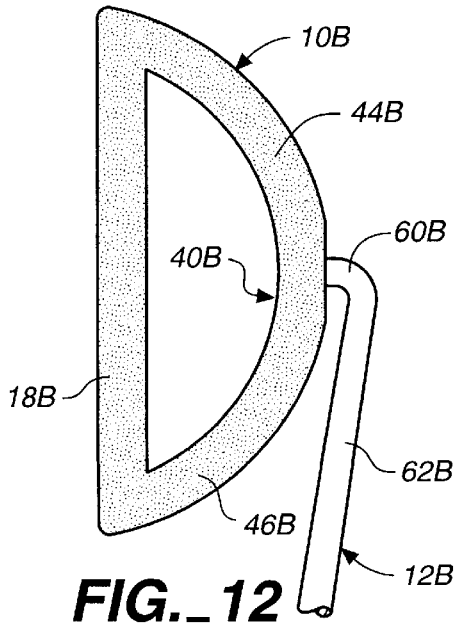
FIG. 12 is a view similar to FIG. 4 taken along the line 12—12 of FIG. 9.
Figure 10:
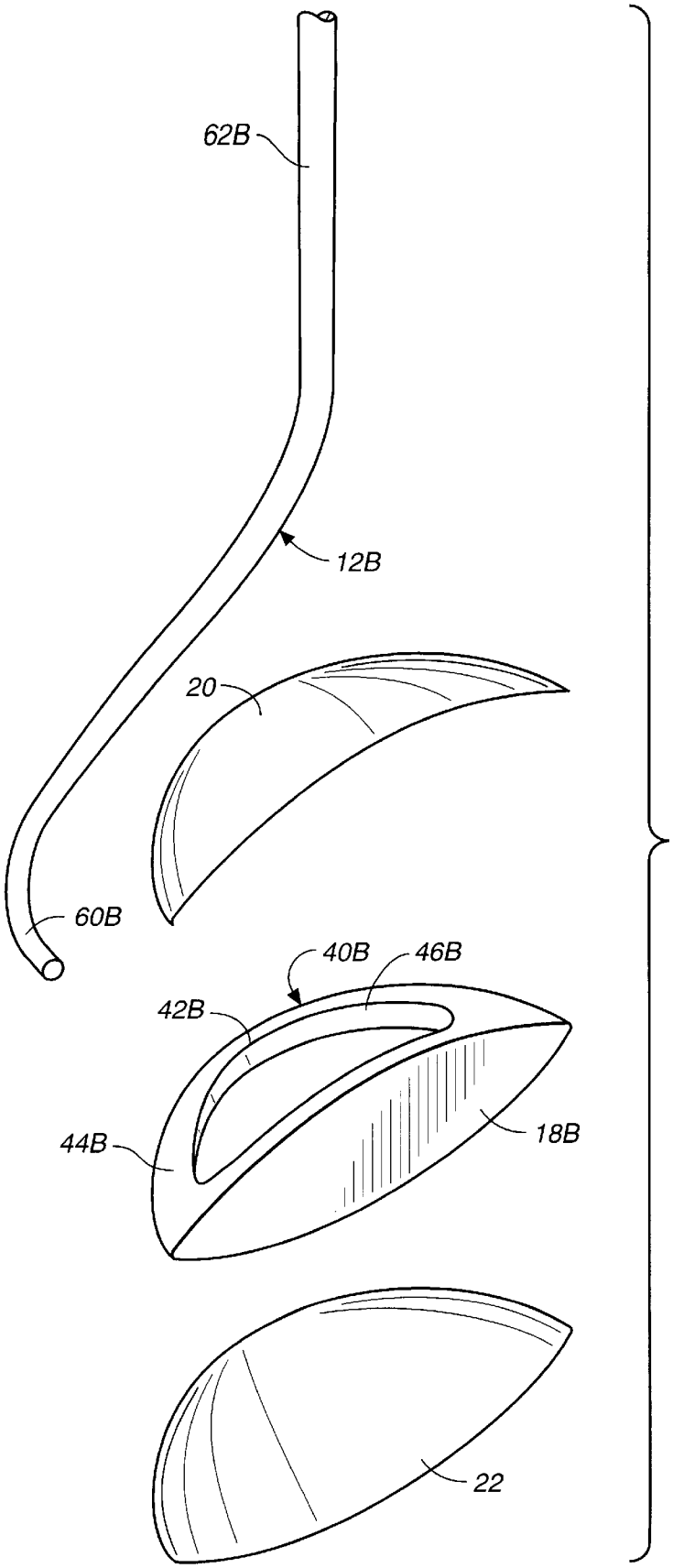
FIG. 10 is a view similar to FIG. 2 of the second alternative embodiment.

FIGS. 1–4 illustrate a golf putter constructed in accordance with the teachings of the present invention. The golf putter includes a club head or putter head 10 having a club shaft 12 connected thereto. The terms "club shaft" and "putter shaft" are interchangeable and such terms encompass not only a shaft per se but also a hosel if such element is employed with the shaft per se.

The club head 10 defines a hollow interior 14. The head 10 includes a club head back portion 16, a club head front portion 18, a club head top portion 20 and a club head bottom portion 22.

The club head portions may be formed of any suitable material and the club head top, bottom and back portions are preferably formed of thin sheet material such as aluminum or other suitable known club head material. The club head front portion 18 has a flat golf ball striking face 24. The club head front portion is thicker than the club head back, top and bottom portions and includes spaced enlarged front portion ends 26 and 28, each of which forms a socket 30.

A reinforcement member 40 constructed of steel or other suitable and relatively heavyweight material is located within the hollow interior of the club head. The reinforcement member 40 includes an attachment element 42 centrally located at the back of the club. Elongated elements 44, 46 are integrally formed therewith and project therefrom. The elongated elements 44, 46 diverge away from one another in the direction of club head front portion 18. The elongated elements have spaced distal ends 50 which fit into the sockets 30 of enlarged front portion ends 26, 28. Reinforcement member 40 and the club head front portion between the first and second front portion ends 26, 28 define a void 54 therebetween.

Shaft 12 includes a first shaft portion 60 and a second shaft portion 62. First shaft portion 60 extends into the club head back portion 16 and is connected to attachment element 42. First shaft portion 60 extends rearwardly from the club head back portion in a direction substantially orthogonal to the striking face 24 of the club head. The first shaft portion 60 may wholly or partially comprise a hosel.

Second shaft portion 62 extends upwardly from the first shaft portion and also extends forwardly therefrom so that at least some of the second shaft portion is disposed over the club head.

Attachment element 42 and elongated elements 44, 46 are disposed in a common plane along with the first shaft portion 60. The elongated elements 44, 46 are straight and have a rod-like configuration. The elongated elements are spaced from and extend between the club head top portion 20 and the club head bottom portion 22. The elongated elements 44, 46 transfer force directly between the shaft and the outer ends of the club head. Furthermore, the elongated elements 44, 46 add stabilizing weight at the ends of the club head. This provides better balance and control of the putter and serves to resist turning of the putter head at impact. In other words, stability is provided to the club head. An extended "sweet spot" exists in the club head front portion 18 because that segment of the club head front portion is free to have a degree of flexibility as compared to the ends thereof. This is due not only to the lesser thickness of the club head front portion at the center thereof but also due to the fact that void 54 exists within the interior of the club head.

FIGS. 5–8 illustrate an alternative embodiment of the invention wherein the club head front portion 18A and the reinforcement member 40A are of integral construction and wherein the elongated elements 44A, 46A are curved rather than straight.

FIGS. 9–12 illustrate yet another alternate embodiment of the invention. In this embodiment club head front portion 18B and elongated elements 44B, 46B are integral. Also, the elongated elements 44B, 46B are curved. Moreover, this embodiment differs from those described above in that the attachment element 42B and the elongated elements 44B, 46B are thicker and extend all the way between the club head top portion 20 and the club head bottom portion 22.

Figure 13:
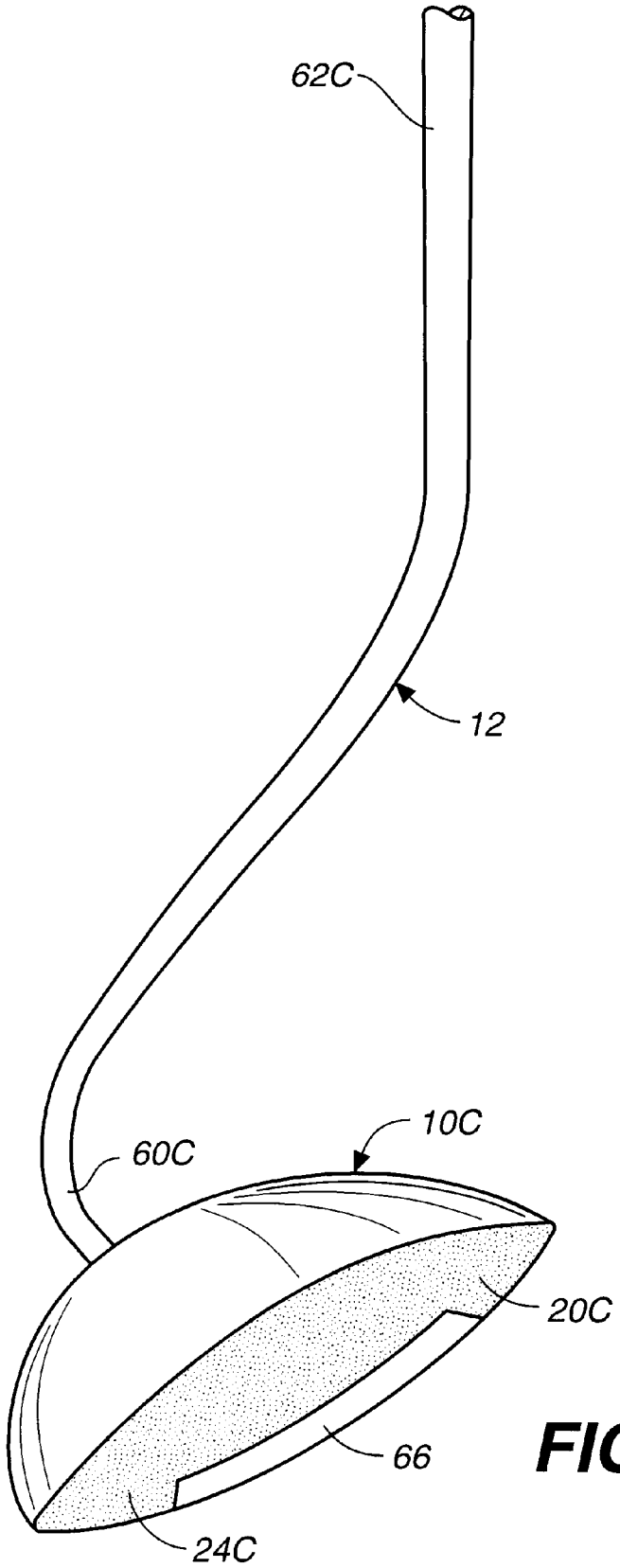
FIG. 13 is a perspective view similar to FIG. 1 illustrating a third alternative embodiment of the invention.

FIG. 13 is a perspective view of another form of putter head. Club or putter head 10C has a club head front portion 20C wherein the golf ball strike face 24C is bevelled inwardly at the bottom thereof in the area identified by reference numeral 66. Such an arrangement makes it less likely that the bottom of the club head will be impeded by grass during movement thereof, an action that can reduce accuracy of the shot or put being made with the club.

I claim:

1. A golf club including, in combination:

a club head defining a hollow interior and including a club head back portion, a club head front portion spaced from said club head back portion and having a golf ball striking face and spaced first and second front portion ends, and a club head top portion connected to said club head front portion and extending rearwardly therefrom over said hollow interior toward the club head back portion; and a reinforcement member connected to said club head and disposed in said hollow interior, said reinforcement member including an attachment element for connection to a club shaft and first and second elongated elements attached to said attachment element and projecting therefrom, said attachment element located at the club head back portion and said first and second elongated elements diverging away from one another in the direction of said club head front portion, said first and second elongated elements having spaced distal ends, the distal end of said first elongated element being attached to said first front portion end and the distal end of said second elongated element being attached to said second front portion end, and said reinforcement member and said club head front portion between said first and second front portion ends defining a void.

2. The combination according to claim 1 additionally including a club shaft, said club shaft including a first shaft portion and a second shaft portion, said first shaft portion connected to said attachment element and extending rearwardly from said club head back portion in a direction substantially orthogonal to the golf ball striking face of the club head, said second shaft portion extending upwardly from said first shaft portion.

3. The combination according to claim 2 wherein said attachment element and said first and second elongated elements are disposed in a common plane along with said first shaft portion.

4. The combination according to claim 1 wherein said club head additionally includes a club head bottom portion and wherein said reinforcement member is spaced from and extends between said club head top portion and said club head bottom portion.

5. The combination according to claim 1 wherein said club head front portion varies in thickness, said first and second front portion ends being thicker than the remainder of said front portion.

6. The combination according to claim 5 wherein said front portion ends define sockets receiving the distal ends of said elongated elements.

7. The combination according to claim 6 wherein each of said elongated elements has a rod-like configuration, said elongated elements being spaced from the club head top portion.

8. The combination according to claim 1 wherein each of said elongated elements is substantially straight.

9. The combination according to claim 1 wherein each of said elongated elements is curved.

10. The combination according to claim 3 wherein said second shaft portion extends forwardly and upwardly from said first shaft portion whereby at least some of said second shaft portion is disposed over said club head.

11. The combination according to claim 1 wherein the club head front portion is integral with said reinforcement member.

12. The combination according to claim 1 wherein said club head additionally includes a bottom club head portion and wherein said reinforcement member extends between and engages both said club head top portion and said club head bottom portion.

13. The combination according to claim 2 wherein said club head comprises a golf putter head.

14. The combination according to claim 13 wherein said first shaft portion connects to said attachment element at a midpoint location on said club head back portion.

15. The combination according to claim 5 wherein the lower end of the golf ball striking face is recessed.

* * * * *